US010984621B2

(12) United States Patent
Oh et al.

(10) Patent No.: US 10,984,621 B2
(45) Date of Patent: Apr. 20, 2021

(54) ACCESS CONTROL APPARATUS

(71) Applicants: CRUCIALTEC CO.LTD, Seongnam-si (KR); CRUCIALTRAK, INC, Seongnam-si (KR)

(72) Inventors: Dong Hyun Oh, Seoul (KR); Yong Hee Han, Gwangju-si (KR); Dong Ho Lee, Seongnam-si (KR)

(73) Assignees: CRUCIALTEC CO.LTD, Seongnam-si (KR); CRUCIALTRAK, INC, Seongnam-si (KR)

( * ) Notice: Subject to any disclaimer, the term of this patent is extended or adjusted under 35 U.S.C. 154(b) by 0 days.

(21) Appl. No.: 16/628,962

(22) PCT Filed: Jun. 25, 2018

(86) PCT No.: PCT/KR2018/007150
§ 371 (c)(1),
(2) Date: Jan. 6, 2020

(87) PCT Pub. No.: WO2019/009552
PCT Pub. Date: Jan. 10, 2019

(65) Prior Publication Data

US 2020/0226864 A1 Jul. 16, 2020

(30) Foreign Application Priority Data

Jul. 5, 2017 (KR) ..... 10-2017-0085630

(51) Int. Cl.
*G07C 9/00* (2020.01)
*E05F 15/42* (2015.01)
(Continued)

(52) U.S. Cl.
CPC ..... *G07C 9/15* (2020.01); *E05F 5/06* (2013.01); *E05F 15/73* (2015.01); *E05G 5/003* (2013.01);
(Continued)

(58) Field of Classification Search
CPC . G07C 9/10; G07C 9/15; G07C 9/025; G07C 2209/62; G07C 9/00007;
(Continued)

(56) References Cited

U.S. PATENT DOCUMENTS

2003/0208966 A1 11/2003 Puskaric et al.
2007/0271846 A1* 11/2007 Miller ..... E06B 11/085 49/49
(Continued)

FOREIGN PATENT DOCUMENTS

EP 0643189 A1 3/1995
EP 1857983 A1 11/2007
(Continued)

*Primary Examiner* — Dionne Pendleton
(74) *Attorney, Agent, or Firm* — Novick, Kim & Lee, PLLC; Jae Youn Kim; Jihun Kim

(57) ABSTRACT

Disclosed is an access control apparatus according to the present invention. The access control apparatus includes: a body located on a passage and having a plurality of support frames; an opening and closing part detachably attached between the plurality of support frames to open and close the passage; and a driving part coupled to the body and the opening and closing part to control an operation of the opening and closing part and having an angle control module for adjusting an opening and closing angle of the opening and closing part and a speed control module for setting an opening and closing speed of the opening and closing part, wherein the driving part controls the opening and closing part so that the opening and closing part is stopped from closing at a given angle through the angle control module.

9 Claims, 11 Drawing Sheets

(51) Int. Cl.

| | |
|---|---|
| ***G07C 9/15*** | (2020.01) |
| ***E05F 15/73*** | (2015.01) |
| ***G07C 9/26*** | (2020.01) |
| ***E05F 5/06*** | (2006.01) |
| ***E05G 5/00*** | (2006.01) |
| ***E06B 11/02*** | (2006.01) |
| ***E06B 11/08*** | (2006.01) |

(52) U.S. Cl.
CPC ..... *E06B 11/02* (2013.01); *E06B 11/085* (2013.01); *G07C 9/00563* (2013.01); *G07C 9/26* (2020.01); *E05Y 2900/40* (2013.01)

(58) Field of Classification Search
CPC ..... G07C 9/00134; G07C 9/00142; G07C 9/00158; G07C 9/00896; G07C 9/20; G07C 9/00; G07C 9/257; G07C 9/28; G07C 9/00563; G07C 9/22; G07C 9/26; G07C 9/37; G07C 2009/00769; G07C 2209/63; G07C 9/00174; G07C 9/00182; G07C 9/00309; G07C 9/00571; G07C 9/00944; G07C 9/253; G07C 9/27; G07C 9/30; G07C 9/32; G07C 9/33; G07C 9/38; E05F 15/73; E05F 15/611; E05F 5/06; G06K 7/10366; G06K 7/10425; G06K 9/00771; G07B 15/00; G07B 15/04; E05G 5/003; E06B 11/02; E06B 11/08; E06B 11/085; E06B 3/90; E06B 11/022; E06B 3/903; E06B 3/906; G08B 13/08; H04N 7/183; E05Y 2400/32; E05Y 2400/326; E05Y 2400/35; E05Y 2900/131
See application file for complete search history.

(56) References Cited

U.S. PATENT DOCUMENTS

| | | | | |
|---|---|---|---|---|
| 2008/0240854 | A1* | 10/2008 | Binns | E06B 11/08 404/6 |
| 2010/0011665 | A1* | 1/2010 | Osann, Jr. | E05G 5/003 49/31 |
| 2016/0217663 | A1* | 7/2016 | Shichiri | G08B 13/08 |
| 2018/0016835 | A1* | 1/2018 | Ichinose | E05F 15/73 |
| 2018/0144563 | A1* | 5/2018 | Reymann | E06B 11/02 |
| 2019/0057561 | A1* | 2/2019 | Zavesky | G16H 40/67 |
| 2019/0244453 | A1* | 8/2019 | Hewitt | G07C 9/00571 |

FOREIGN PATENT DOCUMENTS

| | | | |
|---|---|---|---|
| JP | 4736017 | B2 | 7/2011 |
| KR | 20-0415695 | Y1 | 5/2006 |
| KR | 1020100008237 | A | 1/2010 |
| KR | 20-0460688 | Y1 | 5/2012 |
| KR | 10-1348180 | B1 | 1/2014 |
| KR | 10-1439348 | B1 | 11/2014 |

* cited by examiner

ACCESS CONTROL APPARATUS

TECHNICAL FIELD

The present invention relates to an access control apparatus, and more particularly, to an access control apparatus that is capable of preventing a user from colliding thereagainst.

BACKGROUND ART

An access control apparatus is generally located on an entrance side of a building or subway station so as to admit accesses to only persons having a given requirement for the access to the building or subway station. The access control apparatus is called access gates. Generally, the access gate is operated to allow a door (opening and closing part) to be open if a security card of a user comes into contact therewith. Recently, an access gate has been developed to allow a door to be open through biological identification information like a user's finger print.

Examples of the access gate include a turn type gate, a slide type gate, a swing type gate, and so on.

The turn type gate has a plurality of bars mounted thereon in such a manner as to be rotatable by a shaft. The turn type gate has an advantage like a low installation cost, but inconveniently, users have to directly push the bars so as to pass through the gate.

So as to remove such inconveniences, recently, the slide type gate with an automatically sliding door and the swing type gate with a door rotating around a rotary shaft have been adopted widely.

When compared with the slide type gate, the swing type gate may more frequently cause a user to collide against a door. In detail, when a user who is not admitted passes through the swing type gate, or when a door of the swing type gate is malfunctioned during a user who is admitted passes through the swing type gate, the user passing through the swing type gate may collide against the door.

As shown in FIG. 1, if timing when a door (opening and closing part) of a swing type gate is changed from an opening mode to a closing mode is overlapped with timing when a user passes through the swing type gate, a collision problem A in which a user collides against the door (opening and closing part) of the swing type gate may happen.

If a driving speed of the door (opening and closing part) is increased so as to enhance performance of the swing type gate, especially, the above-mentioned collision problem A may happen more seriously.

Therefore, there is a need for development of a new access control apparatus capable of solving such a collision problem even if the driving speed of the door (opening and closing part) is increased.

DISCLOSURE

Technical Problem

Accordingly, the present invention has been made in view of the above-mentioned problems occurring in the related art, and it is an object of the present invention to provide an access control apparatus that is capable of preventing a user from colliding thereagainst.

It is another object of the present invention to provide an access control apparatus that is capable of enhancing a security level and making it unnecessary to use a security card.

It is yet another object of the present invention to provide an access control apparatus that is capable of displaying first access to one user of a plurality of users or guiding a plurality of users in different directions.

It is still another object of the present invention to provide an access control apparatus that is capable of performing error analysis and management remotely.

The technical problems to be achieved through the present invention are not limited as mentioned above, and other technical problems not mentioned herein will be obviously understood by one of ordinary skill in the art through the following description.

Technical Solution

To accomplish the above-mentioned objects, according to one aspect of the present invention, there is provided an access control apparatus including: a body located on a passage and having a plurality of support frames; an opening and closing part detachably attached between the plurality of support frames to open and close the passage; and a driving part coupled to the body and the opening and closing part to control an operation of the opening and closing part and having an angle control module for adjusting an opening and closing angle of the opening and closing part and a speed control module for setting an opening and closing speed of the opening and closing part, wherein the driving part controls the opening and closing part so that the opening and closing part is stopped from closing at a given angle through the angle control module.

According to the present invention, desirably, the plurality of support frames includes a first support frame and a second support frame having the same shape as each other, and the opening and closing part and the driving part are coupled to each other to constitute an integral type unit whose one surface is coupled to the first support frame and whose other surface is coupled to the second support frame.

According to the present invention, desirably, the opening and closing part includes: a swing door adapted to open and close the passage; and an impact absorber disposed on one surface of the swing door.

According to the present invention, desirably, the access control apparatus further includes a sensing part mounted on one side thereof to sense an object within a given monitoring area.

According to the present invention, desirably, if the object within the given monitoring area is sensed by the sensing part while the swing door is being closed, the angle control module stops the swing door from closing.

According to the present invention, desirably, the plurality of support frames and the integral type unit are provided with magnets on some portions or all portions of the outer edges thereof, and the plurality of support frames and the integral type unit are coupled to each other by means of magnetism of the magnets.

According to the present invention, desirably, the access control apparatus further includes a recognizing part located on one side thereof and having at least one or more modules selected from a finger print recognizing module for recognizing the finger print of the user of the access control apparatus, a vein recognizing module for recognizing the vein shape of the user of the access control apparatus, an iris recognizing module for recognizing the iris of the user of the access control apparatus, and a face recognizing module for recognizing the facial shape of the user of the access control apparatus so as to recognize the user of the access control apparatus, so that if the recognized user of the access control apparatus is an access-admitted person, the access control apparatus opens the opening and closing part by means of the driving part.

According to the present invention, desirably, the access control apparatus further includes a guiding part adapted to guide the use of the access control apparatus and having a first sensing module disposed on one end of the support frame to sense one user of the access control apparatus, a second sensing module disposed on the other end of the support frame symmetrical to one end of the support frame to sense the other user of the access control apparatus, and access guiding modules for guiding accesses to the access control apparatus, so that if any one of the first sensing module and the second sensing module senses one user, the guiding part guides the sensed user to the access control apparatus through the corresponding access guiding module, and if both of the first sensing module and the second sensing module sense the users, the guiding part guides the first sensed user in the sensed order to the access control apparatus through the corresponding access guiding module or guides the closer user on the basis of the sensed distance to the access control apparatus through the corresponding access guiding module.

According to the present invention, desirably, the access guiding modules provide first access to the access control apparatus for one user or the other user by means of lighting of LEDs toward one user or the other user or guide one user and the other user to different ways.

According to the present invention, desirably, the access control apparatus further includes a measuring part for measuring the number of users thereof and a communication part interlocked wirelessly with a predetermined terminal to transmit and receive information having at least one or more information selected from error information of the access control apparatus, information on the user recognition of the recognizing part, and information on the number of users measured by the measuring part to and from the predetermined terminal.

Advantageous Effects

According to the present invention, the access control apparatus can freely adjust an opening and closing angle and an opening and closing speed of the opening and closing part, thereby preventing the user from colliding thereagainst.

In addition, the access control apparatus according to the present invention can stop the opening and closing part from closing at a given angle through the angle control module and the sensing part.

Further, the access control apparatus according to the present invention can be provided with the recognizing part capable of performing recognition for finger print, vein shape, iris shape, and facial shape, thereby enhancing a security level of the access control apparatus and making it unnecessary to use a security card upon the access to the access control apparatus.

Furthermore, the access control apparatus according to the present invention can be provided with the guiding part capable of indicating first access to one user among a plurality of users or guiding the plurality of users to different directions.

Also, the access control apparatus according to the present invention can sense one or more users, so that if the plurality of users is sensed, the access control apparatus guides first access to one given user through LEDs or guides the plurality of users in different directions.

Additionally, the access control apparatus according to the present invention can allow a manager to perform management thereof remotely through the communication part.

Moreover, the access control apparatus according to the present invention can be provided with the body having the magnets mounted on the outer edges thereof, thereby increasing conveniences in coupling, installation, and exchanging thereof.

The effects of the invention are not limited as mentioned above, and it should be understood that the effects of the invention include all effects inferable from the detailed description and claims of the present invention.

MODE FOR INVENTION

Figure 1:
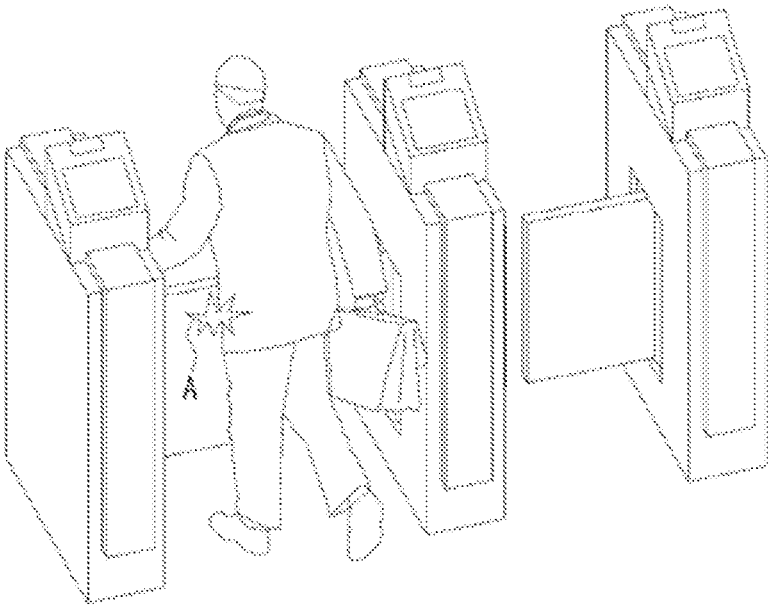
FIG. 1 PRIOR ART
FIG. 1 is a perspective view showing a problem occurring on a conventional swing type gate.

Hereinafter, the present invention will be in detail explained with reference to the attached drawings.

The present invention may be modified in various ways and may have several exemplary embodiments. The following drawings herein illustrate preferred embodiments of the present invention and serve to facilitate the general understanding of the scope of the present invention, together with the detailed description of the present invention. Therefore, the present invention is not limitedly interpreted only with the attached drawings. However, it should be understood that the invention covers all the modifications, equivalents, and replacements within the idea and technical scope of the invention. In order to facilitate the general understanding of the present invention in describing the present invention, through the accompanying drawings, the same reference numerals will be used to describe the same components and an overlapped description of the same components will be omitted.

The term 'modules', and 'parts', as used herein, are used only for the description of the present invention, and therefore, they do not have any distinguishing meaning or roles. If it is determined that the detailed explanation on the well known technology related to the present invention makes the scope of the present invention not clear, the explanation will be avoided for the brevity of the description.

In the description, when it is said that one element is described as being "connected" or "coupled" to the other element, one element may be directly connected or coupled to the other element, but it should be understood that another element may be present between the two elements. When it is said that one portion is described as "includes" any component, further, one element further may include other components unless no specific description is suggested.

Terms used in this application are used to only describe specific exemplary embodiments and are not intended to restrict the present invention. An expression referencing a singular value additionally refers to a corresponding expression of the plural number, unless explicitly limited otherwise by the context. In this application, terms, such as "comprise", "include", or 'have", are intended to designate those characteristics, numbers, steps, operations, elements, or parts which are described in the specification, or any combination of them that exist, and it should be understood that they do not preclude the possibility of the existence or possible addition of one or more additional characteristics, numbers, steps, operations, elements, or parts, or combinations thereof.

Terms, such as the first, the second, A, and B, may be used to describe various elements, but the elements should not be restricted by the terms. The terms are used to only distinguish one element from the other element. For example, a first element may be named a second element without departing from the scope of the present invention. Likewise, a second element may be named a first element.

Figure 2:
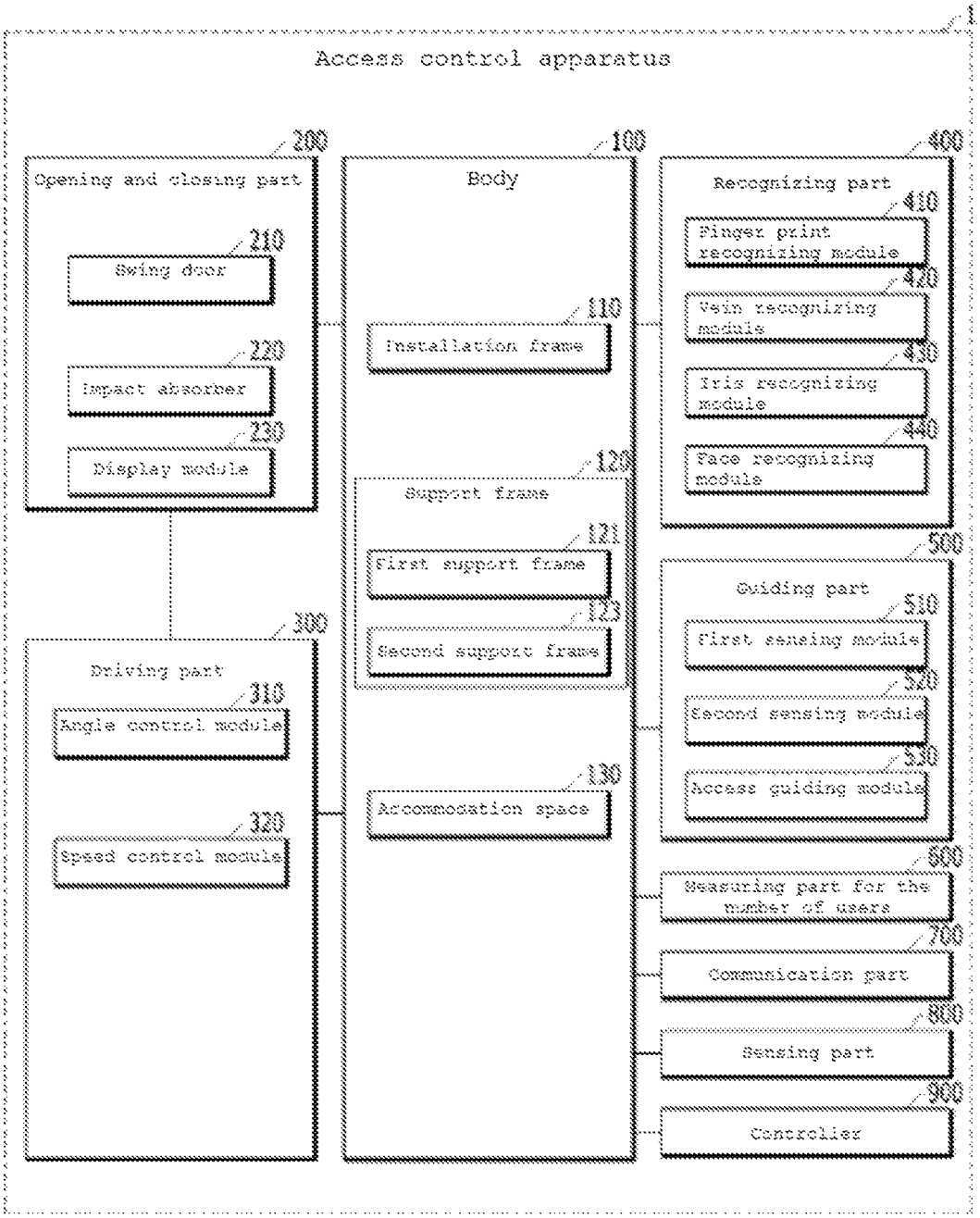
FIG. 2 is a block diagram showing a configuration of an access control apparatus according to the present invention.
Figure 3:
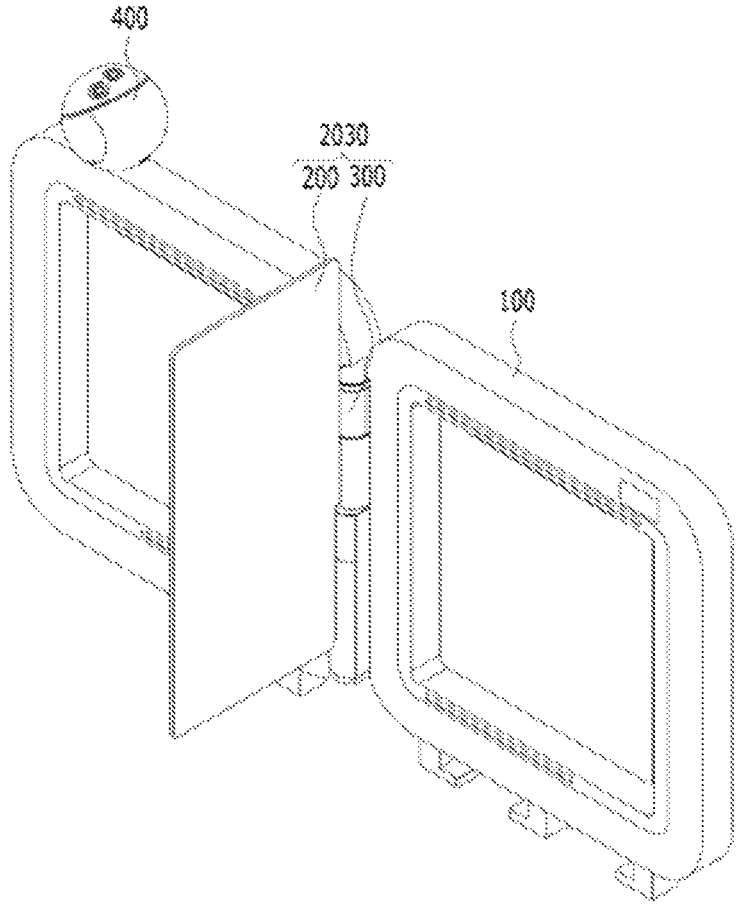
FIG. 3 is a schematic perspective view showing an outer appearance of the access control apparatus according to the present invention.

FIG. 2 is a block diagram showing a configuration of an access control apparatus (hereinafter, referred to as 'access control apparatus 1') according to the present invention, and FIG. 3 is a schematic perspective view showing an outer appearance of the access control apparatus according to the present invention.

As shown in FIGS. 2 and 3, the access control apparatus 1 serves to control a passage and includes a body 100, an opening and closing part 200, and a driving part 300.

Further, the access control apparatus 1 includes a recognizing part 400, a guiding part 500, a measuring part 600 for the number of users, a communication part 700, and a sensing part 800, and in addition thereto, the access control apparatus 1 includes power (not shown), a battery (not shown), and a speaker (not shown).

The body 100 is located on the passage to form an outer appearance of the access control apparatus 1 and serves to support, protect and accommodate the respective parts of the access control apparatus 1.

The opening and closing part 200 serves to open and close the passage and includes a swing door 210, an impact absorber 220, and a display module 230.

The driving part 300 is coupled to the body 100 and the opening and closing part 200 and serves to drive the opening and closing part 200 and also to control an operation of the opening and closing part 200. Further, the driving part 300 includes an angle control module 310 and a speed control module 320.

Also, the opening and closing part 200 and the driving part 300 are coupled to each other to constitute an integral type unit 2030.

FIGS. 4A to 4D are front views showing various examples of the body 100 of the access control apparatus according to the present invention. Now, the body 100 will be explained in detail with reference to FIGS. 4A to 4D.

As shown in FIGS. 4A to 4D, the body 100 includes an installation frame 110, a support frame 120, and an accommodation space 130.

The installation frame 110 is located on the floor of the passage so as to allow the access control apparatus 1 to be installed on the passage.

The support frame 120 is connected to the installation frame 110 to support the access control apparatus 1. Also, the support frame 120 may be located independently on the passage.

The accommodation space 130 is formed on the body 100, and the opening and closing part 200 and the driving part 300 are seated onto the accommodation space 130.

Further, the access control apparatus 1 may include one or more support frames 120, and each support frame 120 may be constituted of a plurality of support frames. For example, the support frame 120 includes a first support frame 121 and a second support frame 123, and further, the support frame 120 includes a third support frame (not shown) and a fourth support frame (not shown).

Figure 4A:
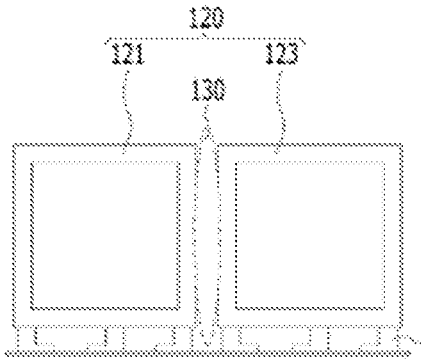
FIGS. 4A to 4D are front views showing various examples of a body of the access control apparatus according to the present invention.
Figure 4B:
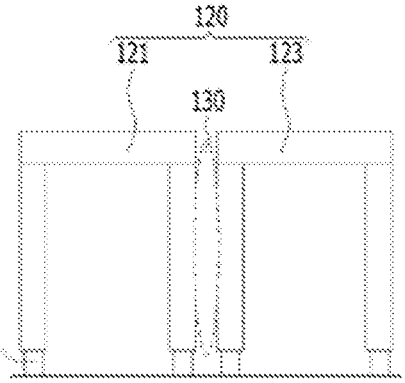

If the support frame 120 is located independently on the passage, as shown in FIGS. 4A and 4B, the installation frame 110 is not a necessary part of the access control apparatus 1.

Figure 4C:
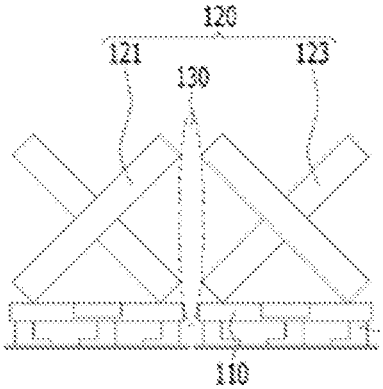
Figure 4D:
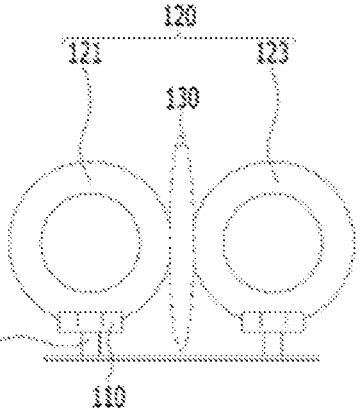

If the support frame 120 is not located independently on the passage and thus cannot support the whole access control apparatus 1, as shown in FIGS. 4C and 4D, the installation frame 110 is located on the passage or a support 401 installed on the passage and serves to connect the support frame 120 and the passage with each other. Accordingly, the access control apparatus 1 can be installed more rigidly on the passage through the installation frame 110.

As shown in FIGS. 4A to 4D, the structures and shapes of the installation frame 110, the support frame 120, and the accommodation space 130 can be freely changed, without any limitation therein.

Further, the first support frame 121 and the second support frame 123 constituting the support frame 120 have the same size and shape as each other, but they do not necessarily have the same size and shape as each other.

For example, as shown in FIG. 4A, the support frame 120 has a structure in which the first support frame 121 having a square shape is coupled to the second support frame 123 having the same shape as the first support frame 121. Further, as shown in FIG. 4B, the support frame 120 has a structure in which the first support frame 121 having a shape of ⊏ is coupled to the second support frame 123 having the same shape as the first support frame 121. Also, as shown in FIG. 4C, the support frame 120 has a structure in which the first support frame 121 having a shape of X is coupled to the second support frame 123 having the same shape as the first support frame 121, and further, as shown in FIG. 4D, the support frame 120 has a structure in which the first support frame 121 having a shape of a circle is coupled to the second support frame 123 having the same shape as the first support frame 121.

The accommodation space 130 is formed on one surface of the body 100. Also, the access control apparatus 1 can have one or more accommodation spaces 130.

Also, the accommodation space 130 is formed between the first support frame 121 and the second support frame 123, and the opening and closing part 200 and the driving part 300 are inserted or detachably attached to the accommodation space 130 formed between the first support frame 121 and the second support frame 123.

When the opening and closing part 200 and the driving part 300 are inserted into the accommodation space 130 together, further, they are coupled to each other to constitute the integral type unit 2030 so as to improve spatial efficiencies. The integral type unit 2030 can be inserted or detachably attached to the accommodation space 130.

Also, the access control apparatus 1 may have one or more integral type units 2030.

If the accommodation space 130 is formed to allow a portion or whole of the integral type unit 2030 made by coupling the opening and closing part 200 and the driving part 300 to each other to be inserted or detachably attached thereto, a size of the accommodation space 130 can be freely set.

According to the present invention, the body 1 has the first support frame 121 and the second support frame 123, but without being limited thereto, as mentioned above, the body 1 further includes the third support frame (not shown) and the fourth support frame (not shown). If the plurality of accommodation spaces 130 is provided, accordingly, each accommodation space 130 is coupled to each support frame 120, and if the plurality of integral type units 2030 is provided, each integral type unit 2030 is coupled to each accommodation space 130.

Further, one surface of the integral type unit 2030 is coupled to the first support frame 121, and the other surface thereof is coupled to the second support frame 123. Without being necessarily limited thereto, however, a coupling way between the integral type unit 2030 and the support frame 120 may be freely changed.

Also, some portions or all portions of the outer edges of the installation frame 110, the support frame 120, the opening and closing part 200, the driving part 300, and the integral type unit 2030 may be formed of magnets. If the installation frame 110, the support frame 120, the opening and closing part 200, the driving part 300, and the integral type unit 2030 are coupled to each other, accordingly, they are coupled to each other by means of magnetism of the magnets formed on the respective outer edges thereof.

In detail, the access control apparatus 1 can be conveniently installed and assembled through the magnetism of the magnets. If the access control apparatus 1 is adopted, accordingly, an installation cost, a re-installation cost, and a repair cost thereof can be reduced.

Figure 5:
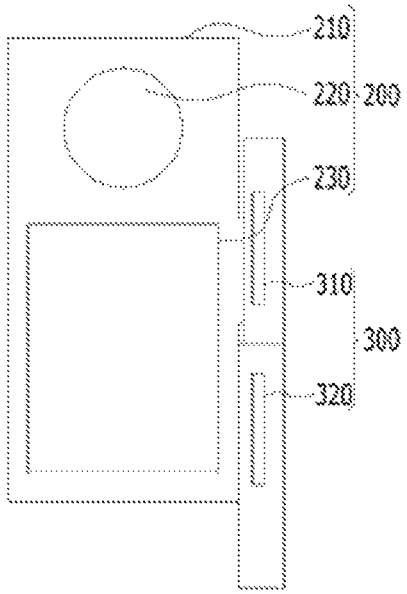
FIG. 5 is a perspective view showing detailed configurations of an opening and closing part and a driving part of the access control apparatus according to the present invention.
Figure 6:
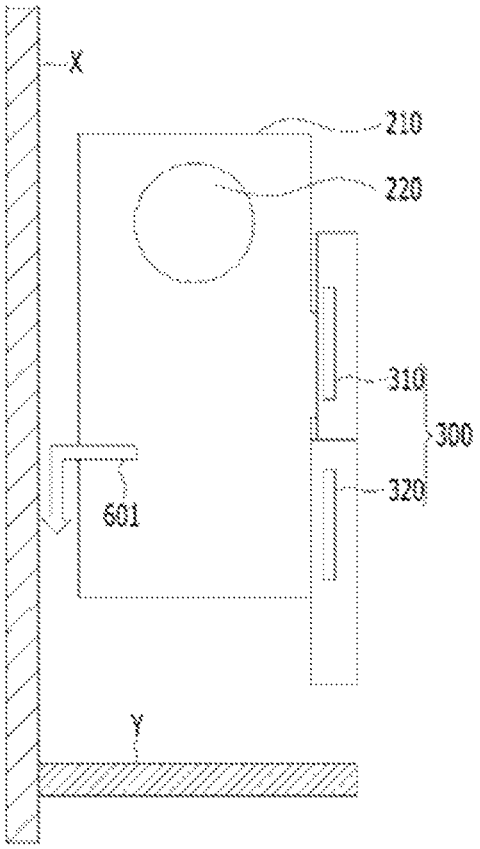
FIG. 6 is a sectional view showing a closing mode of the opening and closing part of the access control apparatus according to the present invention.
Figure 7:
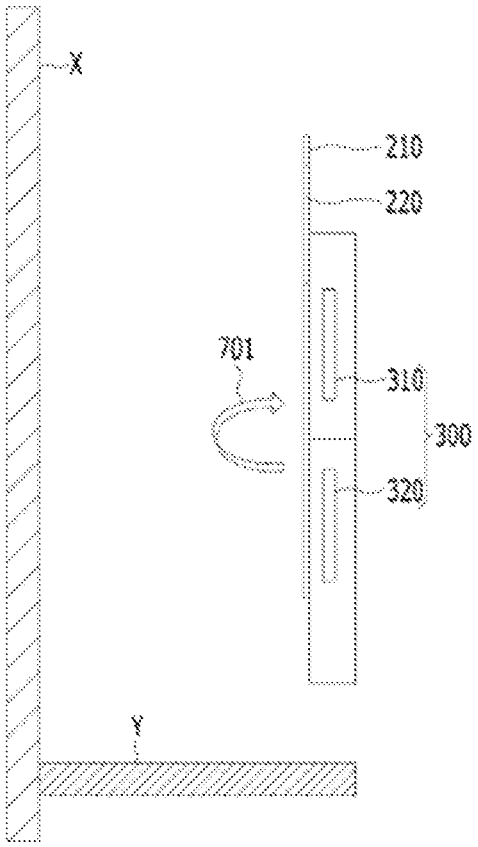
FIG. 7 is a sectional view showing an opening mode of the opening and closing part of the access control apparatus according to the present invention.
Figure 8:
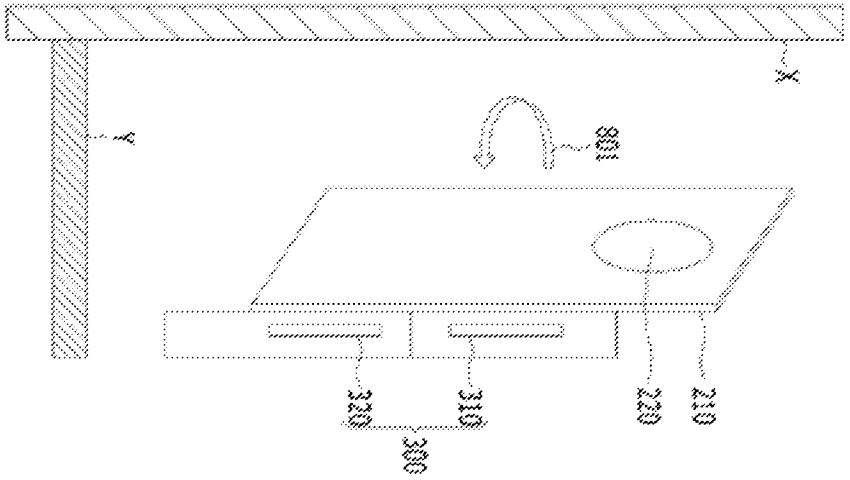
FIG. 8 is a sectional view showing a stop mode of the opening and closing part of the access control apparatus according to the present invention.

FIG. 5 is a perspective view showing detailed configurations of the opening and closing part 200 and the driving part 300 of the access control apparatus according to the present invention, FIG. 6 is a sectional view showing a closing mode of the opening and closing part 200 of the access control apparatus according to the present invention, and FIG. 7 is a sectional view showing an opening mode of the opening and closing part 200 of the access control apparatus according to the present invention. Further, FIG. 8 is a sectional view showing a stop mode of the opening and closing part of the access control apparatus according to the present invention. Now, an explanation on the opening and closing part 200, the driving part 300, and various modes of the opening and closing part 200 of the access control apparatus 1 according to the present invention will be given in detail with reference to FIGS. 5 to 8.

First, the driving part 300 includes the angle control module 310 and the speed control module 320.

The angle control module 310 serves to control an opening and closing angle of the swing door 210. Also, the speed control module 320 serves to adjust an opening and closing speed of the swing door 210. Through the angle control module 310 and the speed control module 320, the access control apparatus 1 can control both of the angle and the speed of the swing door 210, independently of each other. Accordingly, the access control apparatus 1 can enhance variety in opening and closing way for the opening and closing part 200.

The angle control module 310 can stop the swing door 210 from closing at a given angle through the sensing part 800, and an explanation on the stop mode at which the swing door 210 is stopped from closing at the given angle will be in detail given below with reference to FIG. 8.

Next, the opening and closing part 200 includes the swing door 210, the impact absorber 220, and the display module 230.

The swing door 210 is operated by means of the driving part 300, serves to open and close the passage, and is rotated by a rotary shaft.

So as to absorb an impact generated when the user collides against the swing door 210 made of a glass material, generally, the impact absorber 200 is made of a material advantageous in absorbing the impact like rubber.

Accordingly, the access control apparatus 1 can reduce the impact occurring when the user collides against the swing door 210 through the impact absorber 220.

The display module 230 is located on one surface of the swing door 210 and includes bulbs (not shown), LEDs (not shown), and the like with various colors. For example, the display module 230 emits blue light while the access control apparatus 1 is being operated, and contrarily, it emits red light while the access control apparatus 1 is being not operated.

As a result, colors of the swing door 210 can be also varied according to the light colors displayed by the display module 230.

Also, the access control apparatus 1 can display a company logo, a specific pattern, a famous painting, and so on through the display module 230. Therefore, the access control apparatus 1 can perform various promotions and advertisements through the display module 230.

In addition thereto, the access control apparatus 1 can display various colors and pictures according to specific standards through the display module 230, and to this end, the swing door 210 can be adjusted in transparency. For example, a material of the swing door 210 has a transparency value in a range of 0 to 100%.

Also, the swing door 210 includes a transparent electrode as a transparent film on which a metal material is deposited. Further, the swing door 210 is constituted of a liquid crystal display (LCD) or organic light emitting diode (OLED) display making use of the transparent electrode, but it is not necessarily constituted of the LCD or OLED display. The OLED display is a display made through a self-illumination phenomenon in which if an electric current is applied to fluorescent organic compounds, the fluorescent organic compounds emit light, and further, the OLED display has a fast reaction speed and rarely has afterimages.

If the swing door 210 is constituted of the OLED display, the access control apparatus 1 is interlocked with a PC to allow information and data having a large capacity to be displayed on the swing door 210. For example, the access control apparatus 1 can display high quality movies, advertisements, and so on provided from the PC interlocked therewith through the swing door 210 constituted of the OLED display.

Even if the opening and closing part 200 does not have any display module 230, accordingly, the swing door 210 itself can perform the functions of the display module 230. In detail, the swing door 210 serves as a display.

Further, light sources like LEDs can be located along the edges of the swing door 210. For example, a plurality of light sources is spaced apart from each other by a given distance along the outer edges of the swing door 210. At this time, if the plurality of light sources irradiates light onto the outer edges of the swing door 210, the outer edges of the swing door 210 may be illuminated, thereby achieving excellence in design of the access control apparatus 1. According to the present invention, if the plurality of light sources irradiates light onto the inner edges of the swing door 210, the swing door 210 itself may be illuminated. For example, if a light source is mounted on one position of the outer edges of the swing door 210 to emit light, the color of the outer edge on which the light source is mounted is lighter than the color of the inner surface of the swing door 210 facing the outer edge on which the light source is mounted. As a result, the color of the light source emitted from the swing door 210 can have a gradation effect.

In detail, the light source mounted on the outer edge of the swing door 210 emits light to the inner edge of the swing door 210, so that the emitted light is irradiated onto the whole swing door 210. The swing door 210 is made of transparent glass, and if the light source mounted on the outer edge of the swing door 210 emits light to the inside of the swing door 210, a portion or whole of the swing door 210 has the color of the emitted light.

If the swing door 210 having a plurality of light sources mounted along the edges thereof has a shape of a rectangular panel, also, the light sources may be mounted on a portion or whole of the four outer edges of the swing door 210.

Further, the light sources mounted on a portion or whole of the four outer edges of the swing door 210 emit light to display an operating state of the access control apparatus 1 or to guide the use of the access control apparatus 1.

If light sources are mounted on all of the four outer edges of the swing door 210, for example, a situation where only the light sources mounted on the upper edge of the swing door 210 emit light means that the access control apparatus 1 can be available. Further, a situation where the light sources mounted on the four edges of the swing door 210 emit light means that the access control apparatus 1 is kept in a closing mode. If the access control apparatus 1 is changed from the closing mode to an opening mode, the light sources mounted on the four edges of the swing door 210 flicker repeatedly at given time intervals.

In addition thereto, the access control apparatus 1 can perform various functions through the light sources mounted on the edges of the swing door 210. For example, the light sources mounted on the edges of the swing door 210 emit light having various colors, and the colors of light emitted from the light sources indicate specific meaning. If the light sources mounted on the edges of the swing door 210 emit red light, for example, the access control apparatus 1 is in a malfunctioned state, and also, whether the user is accessible to the access control apparatus 1 can be displayed with the light having given colors.

Furthermore, the sizes and shapes of the swing door 210, the impact absorber 220, and the display module 230 are freely determined.

An arrow 601 of FIG. 6 indicates an operation wherein the opening and closing part 200 is kept in the closing mode for closing the passage Y or indicates that the opening and closing part 200 is changed from the opening mode to the closing mode.

If the opening and closing part 200 is in the closing mode, the angle control module 310 controls the opening and closing angle of the swing door 210 so that the opening and closing angle is vertical to a wall surface X, but of course, the opening and closing angle of the swing door 210 is not necessarily limited thereto.

An arrow 701 of FIG. 7 indicates an operation wherein the opening and closing part 200 is kept in the opening mode for opening the passage Y or indicates that the opening and closing part 200 is changed from the closing mode to the opening mode.

If the opening and closing part 200 is in the opening mode, the angle control module 310 controls the opening and closing angle of the swing door 210 so that the opening and closing angle is parallel to the wall surface X, but of course, the opening and closing angle of the swing door 210 is not necessarily limited thereto.

If the opening and closing part 200 is changed to the closing or opening mode, the speed control module 320 serves to control the opening and closing speed of the swing door 210.

For example, an opening and closing speed of the swing door 210 of the access control apparatus 1 located on an entrance of a large building with a large amount of foot traffic can be set differently from that of the swing door 210 of the access control apparatus located on an entrance of a small building with a small amount of foot traffic. Even if one access control apparatus 1 is located on the entrance of a given building, further, an opening and closing speed of the swing door 210 during rush hour when a lot of people are accessed to the access control apparatus 1 can be set differently from that of the swing door 210 during dawn hours when a few people are accessed to the access control apparatus 1.

As mentioned above, further, the access control apparatus 1 includes the sensing part 800.

The sensing part 800 is mounted on one side of the access control apparatus 1 and serves to sense an object within a given monitoring area. Further, the sensing part 800 serves to sense a user's accessing speed to the access control apparatus 1.

For example, the sensing part 800 can sense a plurality of objects existing within a radius of 1 m of the access control apparatus 1. While the swing door 210 is being changed from the opening mode to the closing mode, for another example, the sensing part 800 can sense the user accessing to the access control apparatus 1 and the user's accessing speed to the access control apparatus 1. In this case, the objects include all objects capable of passing through the access control apparatus 1 as well as the users of the access control apparatus 1.

If the sensing part 800 senses an object within the given monitoring area while the swing door 210 is being changed from the opening mode to the closing mode, the angle control module 310 controls the swing door 210 to allow the swing door 210 to be stopped from closing at a given angle, as shown by an arrow 801 in FIG. 8. In this case, the given angle is 45°, but it is not necessarily limited thereto.

If the sensing part 800 senses an object within the given monitoring area while the swing door 210 is being changed from the opening mode to the closing mode, further, the angle control module 310 stops the swing door 210 from closing. The operation in which the sensing part 800 senses an object within the given monitoring area while the swing door 210 is being changed from the opening mode to the closing mode and the operation in which the angle control module 310 stops the swing door 210 from closing are carried out sequentially or almost simultaneously.

Accordingly, the access control apparatus 1 can in advance prevent the user from colliding thereagainst through the sensing part 800 and the angle control module 310.

For example, if the sensing part 800 senses the user of the access control apparatus 1 within a radius of 1 m of the access control apparatus 1 as the given monitoring area, while the swing door 210 is being changed from the opening mode to the closing mode, the access control apparatus 1 can immediately stop the swing door 210 from closing. At this time, an angle of the swing door 210 stopped from closing is in the range of 0 to 90°.

Figure 9:
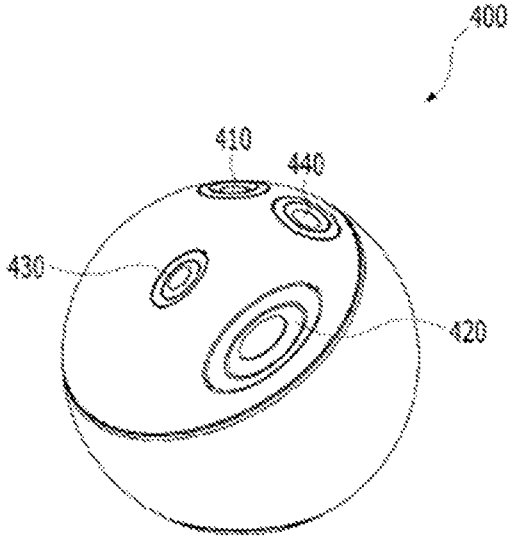
FIG. 9 is a perspective view showing a detailed configuration of a recognizing part of the access control apparatus according to the present invention.

FIG. 9 is a perspective view showing a detailed configuration of the recognizing part 400 of the access control apparatus according to the present invention.

The access control apparatus 1 can admit access to access-admitted persons through the recognizing part 400.

The recognizing part 400 includes at least one or more modules selected from a finger print recognizing module 410 for recognizing the finger print of the user of the access control apparatus 1, a vein recognizing module 420 for recognizing the vein shape of the user of the access control apparatus 1, an iris recognizing module 430 for recognizing the iris of the user of the access control apparatus 1, and a face recognizing module 440 for recognizing the facial shape of the user of the access control apparatus 1.

The recognizing part 400 can recognize the user of the access control apparatus 1 through only one of the four recognizing modules 410, 420, 430 and 440, but if it is necessary to enhance a security level, the recognizing part 400 recognizes the user of the access control apparatus 1 through all of the four recognizing modules 410, 420, 430 and 440.

Further, the recognizing part 400 further includes a storage (not shown) or user register (not shown) having a database form in which user information having at least one or more pieces of information selected from finger print, vein, iris, and face information of the user is stored.

The recognizing part 400 compares user information in advance stored in the storage (not shown) or the user register (not shown) with the user's finger print, vein shape, iris, and facial shape recognized through the respective modules 410, 420, 430 and 440, and if the user information corresponds to the recognized user information, the access control apparatus 1 can change the opening and closing part 200 to the opening mode through the driving part 300. Contrarily, if not, the access control apparatus 1 can keep the opening and closing part 200 to the closing mode through the driving part 300.

In addition, if the user information does not correspond to the recognized user information through the recognizing part 400, the access control apparatus 1 can provide predetermined sounds through a speaker (not shown). For example, if the user information does not correspond to the recognized user information through the recognizing part 400, the access control apparatus 1 can provide sounds like "You are not admitted" or "Please let me recognize you again" through the speaker (not shown).

Further, the respective modules 410, 420, 430 and 440 can sense the finger print, the vein shape, the iris, and the facial shape to be recognized through an optical method using cameras. At this time, the respective modules 410, 420, 430 and 440 are close to each other so that the access control apparatus 1 can enhance a user recognizing efficiency.

Furthermore, if the recognizing part 400 has a shape of a ball or column, the respective modules 410, 420, 430 and 440 are located at the hollow interior of the recognizing part 400, and a housing made of a transparent material like glass is mounted on the outer periphery of the recognizing part 400.

Also, the recognizing part 400 can perform the recognition for the finger print or vein shape of the user even if the user's body does not come into direct contact therewith, and further, the recognizing part 400 can perform the recognition for the facial shape or iris shape of the user even while the user is accessing thereto.

The user information recognized or acquired by the recognizing part 400 can be called user biological data having at least one of the finger print, vein, iris, and facial shapes of the user. The respective modules 410, 420, 430 and 440 can recognize or acquire the user biological data sensible thereby, independently of each other.

If the recognizing part 400 includes all of the modules 410, 420, 430 and 440, the access control apparatus 1 can open the opening and closing part 200 even in a case where a portion of the user biological data sensed by the modules 410, 420, 430 and 440 is recognized. For example, even if only the finger print sensing through the finger print recognizing module 410 is finished, the access control apparatus 1 can open the opening and closing part 200. Accordingly, the recognizing speed of the recognizing part 400 can be increased, and also, the driving speed for opening and closing the access control apparatus 1 can be raised.

Figure 10:
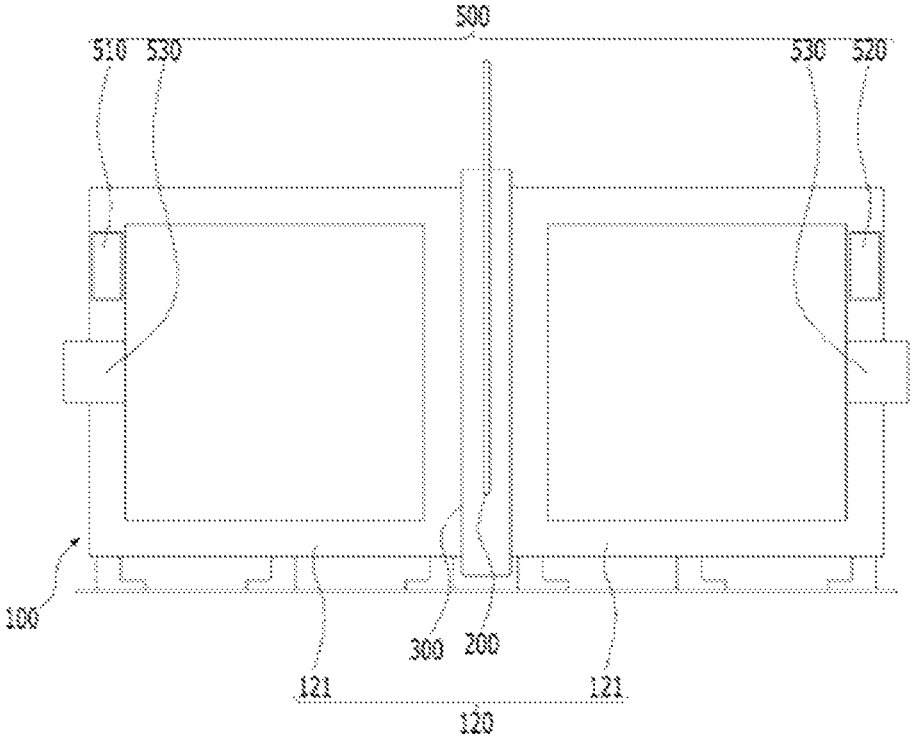
FIG. 10 is a side view showing a detailed configuration of a guiding part of the access control apparatus according to the present invention.

FIG. 10 is a side view showing a detailed configuration of the guiding part 500 of the access control apparatus according to the present invention.

The guiding part 500 serves to sense users of the access control apparatus 1. If a plurality of users is sensed, further, the guiding part 500 performs access guiding to the access control apparatus 1 for the users, thereby improving the user's conveniences in use.

In detail, the guiding part 500 includes a first sensing module 510 disposed on one end of the body 1, a second sensing module 520 disposed on the other end of the body 1, and access guiding modules 530. The first sensing module 510 and the second sensing module 520 are located on the access control apparatus 1, but of course, they may be located on positions separated from the access control apparatus 1.

The access control apparatus 1 is installed on the passage to control the access to the passage, and in this case, generally, the user can be accessed to two ways of the access control apparatus 1. Accordingly, the first sensing module 510 and the second sensing module 520 are located symmetrically to each other on both ends of the support frames 120 around the support frames 120.

For example, the first sensing module 510 is located on one end of the first support frame 121, and the second sensing module 520 is located on one end of the second support frame 123 disposed symmetrically to one end of the first support frame 121.

One or more access guiding modules 530 are located on the access control apparatus 1. For example, if two access guiding modules 530 are located on the access control apparatus 1, they are located at the positions close to the first sensing module 510 and the second sensing module 520 so as to guide the two-way users.

The first sensing module 510 serves to sense one side user of the access control apparatus 1 to measure a distance from the sensed user. The second sensing module 520 serves to sense the other side user of the access control apparatus 1 to measure a distance from the sensed user.

If any one of the first sensing module 510 and the second sensing module 520 senses the user, after that, the guiding part 500 can guide the sensed user to the access control apparatus 1 through the access guiding module 530. If both of the first sensing module 510 and the second sensing module 520 sense the users, further, the guiding part 500 can guide the first sensed user in the sensed order to the access control apparatus 1 through the access guiding module 530, and otherwise, the guiding part 500 can guide the closer user on the basis of the sensed distance to the access control apparatus 1 through the access guiding module 530.

In detail, the guiding part 500 performs access guiding for the sensed users according to various standards like the sensed order or distance and also guides the plurality of users to different ways.

Further, the guiding part 500 compares a distance from one side user measured through the first sensing module 510 with a distance from the other side user measured through the second sensing module 520 and guides one side user and the other side user to the access control apparatus 1 through the access guiding modules 530. At this time, the access guiding modules 530 can provide first access to the access control apparatus 1 for one side user or the other side user by means of lighting of LEDs. The access guiding module 530 does not have any limitations in a method and form in lighting the LEDs.

For example, if it is desired that the plurality of users simultaneously accesses to the access control apparatus 1, the first sensing module 510 and the second sensing module 520 mounted at the symmetrical positions of the access control apparatus 1 sense the users located at their respective positions and measure the distances from the users. After that, the guiding part 500 compares the distance measured through the first sensing module 510 with the distance measured through the second sensing module 520, and the guiding part 500 thus guides the user located at the closer distance by displaying the LEDs indicating an arrow mark or a phrase "allowed" through the access guiding module 530, while guiding the user located at a relatively long distance by displaying the LEDs indicating an X mark or a phrase "not allowed" or "Please wait for a while" through the access guiding module 530.

Also, the functions of the access guiding modules 530 can be replaced with those of the display module 230.

For example, the guiding part 500 compares the distance measured through the first sensing module 510 with the distance measured through the second sensing module 520 and guides one side user and the other side user to the access control apparatus 1 through the display module 230. At this time, the display module 230 emits light having given colors toward one side user and the other side user to guide them to the access control apparatus 1. In this case, the given colors include light having various colors like red, blue, and so on, and the display module 230 may emit the light having two or more colors simultaneously.

As a result, the access control apparatus 1 can increase the user conveniences and prevent collision between the plurality of users and the access control apparatus 1 when the plurality of users simultaneously access thereto.

Referring back to FIG. 2, as mentioned above, the access control apparatus 1 further includes the measuring part 600 for the number of users thereof, the communication part 700 for transmitting and receiving the information related thereto to and from a predetermined terminal, and a controller 900 for monitoring the information related thereto.

The measuring part 600 for the number of users and the communication part 700 are also located on the access control apparatus 1.

The communication part 700 is interlocked with the predetermined terminal wirelessly and transmits the information related to at least one or more parts of the body 100, the opening and closing part 200, the driving part 300, the recognizing part 400, the guiding part 500, the measuring part 600 for the number of users, and the communication part 700 to the predetermined terminal.

The communication part 700 makes use of wireless communication technology when it transmits the information. For example, the communication part 700 makes use of wireless communication technology such as Bluetooth, Zigbee, LTE, and Wi-Fi, but of course, it is not limited thereto.

The predetermined terminal is a communicable digital device. For example, the predetermined terminal includes a smart phone, a smart pad, a smart glass, a smart winch, a laptop, a computer, or PDA, but of course, it is not limited thereto.

The measuring part 600 for the number of users serves to measure the number of users of the access control apparatus 1 through at least one or more information selected from information on the number of driving times of the opening and closing part 200, information on the number of times for the user recognition of the recognizing part 400, and information on the number of times for user access guiding of the guiding part 500. Also, the measuring part 600 for the number of users can measure the number of users according to given standards like the number of users for a day, the number of users during specific time.

The information transmitted from the communication part 700 to the predetermined terminal includes at least one or more information selected from error information related to at least one or more parts of the body 100, the opening and closing part 200, the driving part 300, the recognizing part 400, the guiding part 500, the measuring part 600 for the number of users, and the communication part 700, information on the number of driving times of the opening and closing part 200, information on the number of times for the user recognition of the recognizing part 400, and information on the number of users of the access control apparatus 1 measured by the measuring part 600.

The controller 900 serves to display the information related to the access control apparatus 1 by means of a display module (not shown). Further, the controller 900 serves to monitor the information related to the access control apparatus 1 by means of separate software or to change setting of the respective parts of the access control apparatus 1.

For example, the controller 900 performs mode changes of the opening and closing part 200, recognition method setting and changes of the recognizing part 400, guiding method setting and changes of the guiding part 500, information transmission to the predetermined terminal through the communication part 700, sound setting and changes of the speaker (not shown) located on the access control apparatus 1, and error information acquisition and display of the respective parts of the access control apparatus 1.

Through the information transmission and reception of the communication part 700, the predetermined terminal can perform analysis, management and error analysis of the information related to the access control apparatus 1. Through control software of the access control apparatus 1 stored in the predetermined terminal, further, the access control apparatus 1 can be repaired or managed remotely. Even if the access control apparatus 1 is not disassembled, also, the controller 900 can change the setting of the access control apparatus 1 and monitor the access control apparatus 1. Accordingly, conveniences for the manager of the access control apparatus 1 can be improved.

Figure 11:
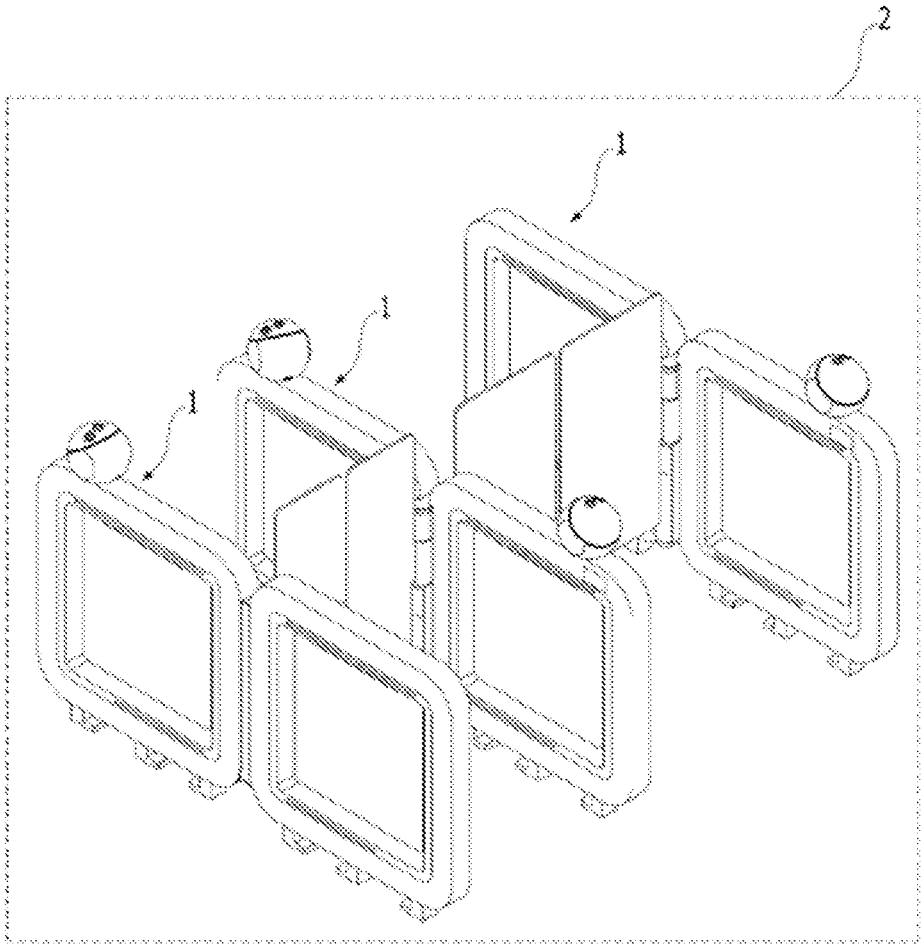
FIG. 11 is a perspective view showing an access control system having the plurality of access control apparatuses according to the present invention.

FIG. 11 is a perspective view showing an access control system 2 having the plurality of access control apparatuses 1 according to the present invention, and the access control system 2 will be in detail explained with reference to FIGS. 2 to 12.

As shown in FIG. 11, a plurality of access control apparatuses 1 is located to build the access control system 2. Further, the plurality of access control apparatuses 1 is spaced apart from each other by a given distance.

Also, the access control apparatuses 1 may be paired two of each with each other in such a manner as to face each other to build the access control system 2, and they can be operated in the same manner as each other.

Further, the sizes and shapes of the swing doors 210 of the respective access control apparatuses 1 are freely made to build the access control system 2.

The functions of the above-mentioned access control apparatus 1 and the access control system 2 can be carried out by means of external power or batteries built therein. Further, the respective parts of the access control apparatus 1 can be connected or interlocked with each other wiredly or wirelessly, and the functions of the respective parts can be controlled, independently of each other. However, they are not necessarily controlled, independently of each other, and of course, they are controlled in such a manner as to be physically or electrically dependent on each other.

If the access control apparatus 1 is adopted, the opening and closing angle and the opening and closing speed of the swing door 210 can be freely set through the driving part 300 having the angle control module 310 and the speed control module 320. Accordingly, the variety in control of the swing door 210 can be enhanced.

Further, the access control apparatus 1 is configured to allow the sensing part 800 and the angle control module 310 to stop the swing door 210 from closing if the sensing part 800 senses an object within the given monitoring area or to stop the swing door from closing at the given angle, thereby preventing the user from colliding thereagainst.

Even if the user collides against the access control apparatus 1, the access control apparatus 1 is provided with the impact absorber 220 made of the material advantageous in absorbing the collision impact, thereby minimizing the impact applied to the user.

Further, the access control apparatus 1 enhances the security level thereof through the recognizing part 400, so that it can be used, without any security card only therefor, and the access control apparatus 1 displays first access to one user among a plurality of users or guides the plurality of users to different directions through the guiding part 500. Also, the access control apparatus 1 allows a manager to perform management thereof remotely through the communication part 700.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention. It should be therefore understood that the embodiments of the present invention are just exemplary embodiments, while not limiting the present invention. For example, the parts expressed in a singular form may be dispersedly provided, and in the same manner as above, the parts dispersed may be combined with each other. The present invention may be modified in various ways and may have several exemplary embodiments. Specific exemplary embodiments of the present invention are illustrated in the drawings and described in detail in the detailed description. However, this does not limit the invention within specific embodiments and it should be understood that the invention covers all the modifications, equivalents, and replacements within the idea and technical scope of the invention.

The invention claimed is:

1. An access control apparatus comprising:

a body located on a passage and having a plurality of support frames;

an opening and closing assembly detachably attached between the plurality of support frames to open and close the passage; and a driving circuit coupled to the body and the opening and closing assembly and configured to control an operation of the opening and closing assembly so as to adjust an opening and closing angle of the opening and closing assembly and to set an opening and closing speed of the opening and closing assembly, wherein the driving circuit is configured to control the opening and closing assembly to be stopped from closing at a given angle, wherein the plurality of support frames includes a first support frame and a second support frame having the same shape as each other, and the opening and closing assembly and the driving circuit are coupled to each other to form an integral type unit having one surface coupled to the first support frame and having another surface coupled to the second support frame, wherein the plurality of support frames and the integral type unit include magnets disposed on outer edges thereof, and the plurality of support frames and the integral type unit are coupled to each other by means of magnetism of the magnets.

2. The access control apparatus according to claim 1, wherein the opening and closing assembly comprises:

a swing door adapted to open and close the passage by swinging movement; and an impact absorber disposed on one surface of the swing door.

3. The access control apparatus according to claim 2, further comprising a sensor mounted on one side thereof to sense an object within a given monitoring area.

4. The access control apparatus according to claim 3, wherein when the object within the given monitoring area is sensed by the sensor while the swing door is being closed, the driving circuit is configured to stop the swing door from closing.

5. The access control apparatus according to claim 1, further comprising a recognizing assembly located on one side thereof and configured for recognizing a finger print of an user of the access control apparatus, for recognizing a vein shape of the user of the access control apparatus, for recognizing an iris of the user of the access control apparatus, or for recognizing a facial shape of the user of the access control apparatus so as to recognize the user of the access control apparatus, such that, when the recognized user of the access control apparatus is an access-admitted person, the access control apparatus opens the opening and closing assembly by means of the driving circuit.

6. The access control apparatus according to claim 5, further comprising a processor configured for measuring the number of users and for communicating wirelessly with a predetermined terminal to transmit and receive information having at least one or more information selected from error information of the access control apparatus, information on a user recognition of the recognizing assembly, and information on the number of users to and from the predetermined terminal.

7. An access control system comprising a plurality of access control apparatuses according to claim 1, wherein the plurality of access control apparatuses are spaced apart from each other by given distances.

8. An access control apparatus comprising:

a body located on a passage and having a plurality of support frames;

an opening and closing assembly detachably attached between the plurality of support frames to open and close the passage; and a driving circuit coupled to the body and the opening and closing assembly and configured to control an operation of the opening and closing assembly so as to adjust an opening and closing angle of the opening and closing assembly and to set an opening and closing speed of the opening and closing assembly, wherein the driving circuit is configured to control the opening and closing assembly to be stopped from closing at a given angle, wherein the plurality of support frames includes a first support frame and a second support frame having the same shape as each other, and the opening and closing assembly and the driving circuit are coupled to each other to form an integral type unit having one surface coupled to the first support frame and having another surface coupled to the second support frame, the access control apparatus further comprising a guiding assembly adapted to guide a user of the access control apparatus and having a first sensor disposed on one end of the body to sense one user of the access control apparatus, and a second sensor disposed on another end of the body symmetrical to the one end of the body to sense another user of the access control apparatus, and configured for guiding accesses to the access control apparatus, such that, when any one of the first sensor and the second sensor senses one user, the guiding assembly guides the sensed user to the access control apparatus, and when both of the first sensor and the second sensor sense a plurality of users, the guiding assembly guides a first sensed user in accordance with a sensed order to the access control apparatus or guides a closer user on the basis of a sensed distance to the access control apparatus.

9. The access control apparatus according to claim 8, wherein the guiding assembly is configured to provide an access guiding to one user by means of LED lighting of toward the one user.

* * * * *